United States Patent [19]

Baker et al.

[11] 4,066,319

[45] Jan. 3, 1978

[54] METHOD AND APPARATUS FOR FLAT CONDUCTOR CABLE TERMINATION

[75] Inventors: Charles E. Baker, Doylestown; Abraham Silverzweig, Broomall, both of Pa.

[73] Assignee: Elco Corporation, Willow Grove, Pa.

[21] Appl. No.: 465,594

[22] Filed: Apr. 30, 1974

[51] Int. Cl.[2] ..... H01R 9/06

[52] U.S. Cl. ..... 339/97 R; 339/17 F; 339/97 C

[58] Field of Search ..... 339/17 F, 176 MF, 95 R, 339/99 R, 97 R, 97 C, 96, 276 R, 276 T; 29/628; 174/88 R, 84 C

[56] References Cited

U.S. PATENT DOCUMENTS 3,840,840 10/1974 Worth ..... 339/17 F X

*Primary Examiner*—Roy Lake
*Assistant Examiner*—E. F. Desmond
*Attorney, Agent, or Firm*—Burns, Doane, Swecker & Mathis

[57] ABSTRACT

A termination method and apparatus for flexible flat conductor cable utilizing a contact having a pair of cable penetrating prongs for penetrating completely through a conductor of the flexible cable and a pair of biased abutment surfaces cooperable with the prongs for forming a crimp at a location remote from the penetration is disclosed. The prongs may be arranged in a manner to form a biased contact bridge therebetween after the connector has been attached to the cable. A die is employed to enforce cable penetration and bending of the prongs in a single movement lancing operation.

16 Claims, 5 Drawing Figures

FIG. 1
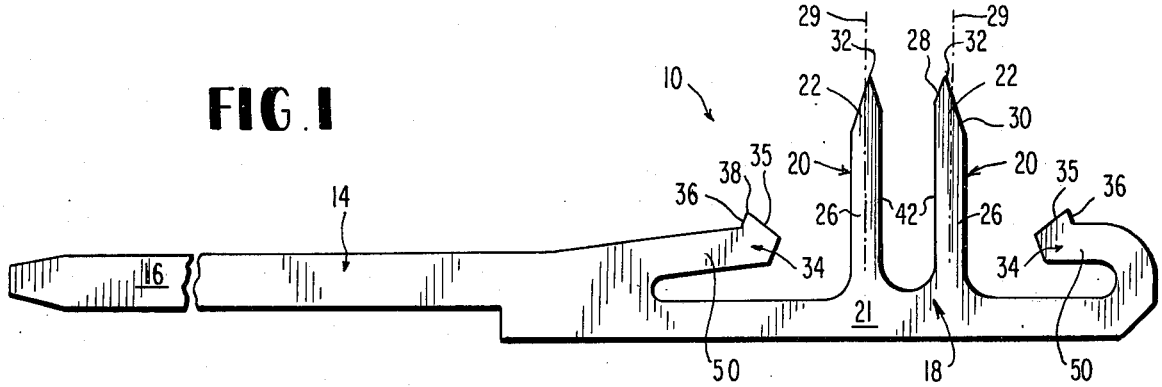
FIG. 2
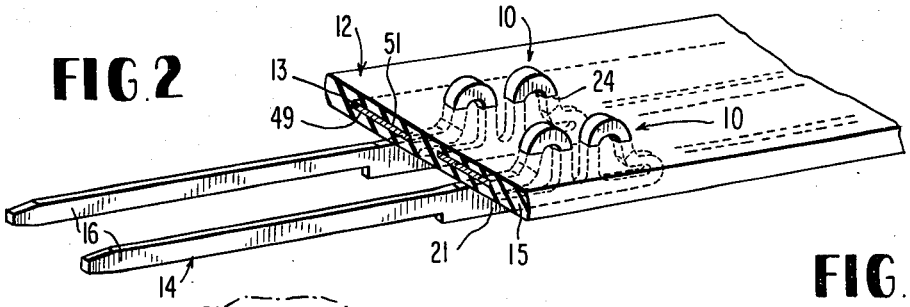
FIG. 4
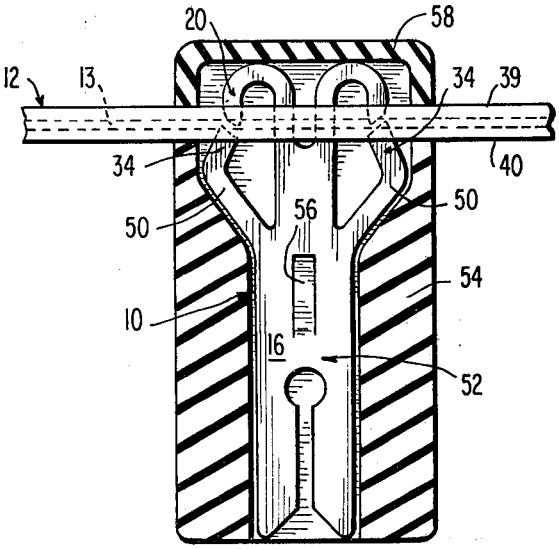
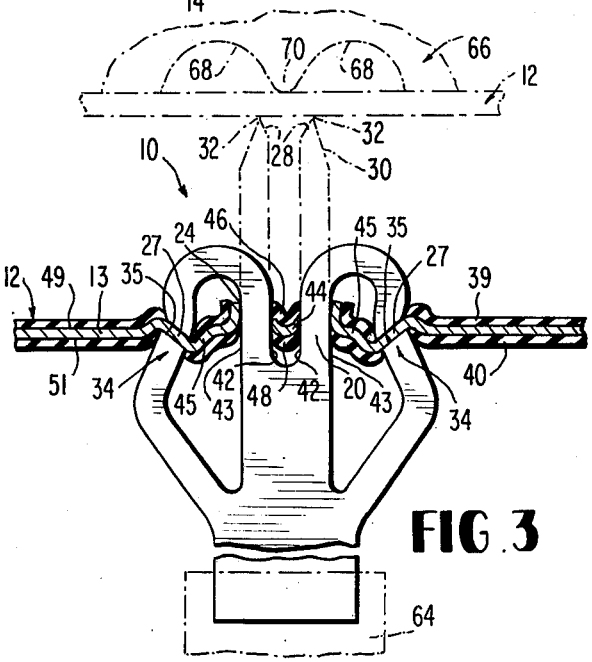
FIG. 3
FIG. 5
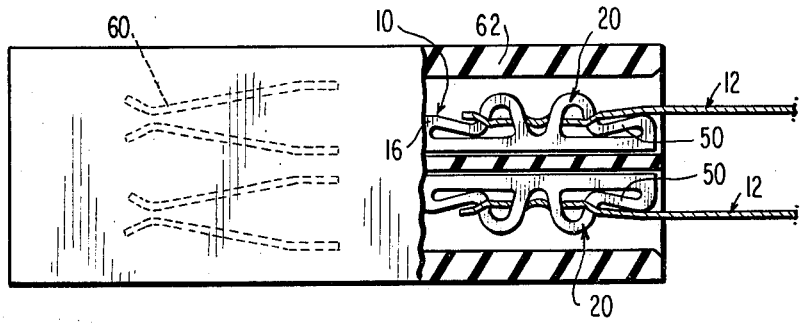

METHOD AND APPARATUS FOR FLAT CONDUCTOR CABLE TERMINATION

BACKGROUND OF THE INVENTION

The present invention relates to multiple contact connectors. More particularly, the invention relates to multiple contact connectors for the termination of flexible flat conductor means such as flexible flat cable and flexible etched circuitry.

Conventionally, flexible flat conductor cable has a plurality of flat, ribbon-like conductors embedded in an insulating medium, e.g., polyester, wherein the conductors lie generally parallel to each other in a single plane.

Flexible flat conductor cable is being used in wiring applications to an increasing extent as a result of its compactness and advantageous electrical characteristics. For example, it has been found that this type of cable may very easily be replaced and/or installed under relatively crowded conditions which would render other conventional wiring arrangements costly, burdensome, and subject to wiring errors. However, the commercial utility of flexible flat conductor cable has been hampered by the lack of a particularly suitable termination contact.

In the past, connector devices for flat conductor cable have been provided which utilize both crimp-type terminations and solder-type terminations. In the case of many of these devices, it has been necessary to prepare a portion of the cable in order to receive the connector. For example, in many instances it is necessary to strip the insulation from the end of the cable prior to application of the contact to the cable. In other instances, the cable may require a pre-perforation to accommodate a portion of the contact (see e.g., U.S. Pat. Nos. 3,675,180 or 3,768,062).

In the use of yet other devices, it is not necessary to remove a portion of the insulation material. The insulation may be pierced by a contact which straddles a conductor of the cable. The contact may then be crimped to the conductor to effect an electrical connection (see U.S. Pat. No. 3,395,381). This prior art arrangement may in some instances require a relatively large interspace between the plurality of parallel, ribbon-like conductors which make up the cable. Moreover, these prior art connecting devices, by virtue of their straddling relationship with the conductors, require a crimp in a direction generally transverse to a longitudinal axis of the conductor. Thus, if the width of the conductors varies, the contact width must be varied to accommodate that width; and, if an attempt is made to standardize the contact width, the utility of the contact would be limited or significant conductor cable preparation would be required.

In addition, such prior art connecting devices dictate the maintenance of critical tolerances, and often result in formation of slivers of conductor cable by unintended shaving of the conductor during application of the contact. Furthermore, simultaneous termination is difficult if not impractical, and, if a large number of contacts are to be employed, flow of the plastic insulating material could adversely displace the conductors of the cable from their intended location.

The present invention falls into the category of terminating devices for flexible flat conductor cable wherein the insulation is pierced and substantially no prior preparation of the cable is necessary at the location chosen to terminate the cable.

There has been suggested in the prior art a terminal for flexible circuits which has tangs intended to penetrate the full thickness of the flexible circuit in order to thereby "staple" the terminal onto the flexible circuit at a pre-perforated location (see U.S. Pat. No. 3,768,062).

The device disclosed in the U.S. Pat. No. 3,768,062, proposes a terminal for flexible circuits which rests on a rim portion of the terminal extending generally normal to a generally planar base portion. According to this proposal, tangs, which are formed from an extension of the rim, penetrate the full thickness of the flexible circuit at a pre-perforated zone of enlarged width on the flexible circuit. After penetrating through the circuit, the tangs are bent against an outer layer of the circuit. It has been further suggested that, if desired, these tangs upon attachment of the terminal could be driven against an anvil of suitable configuration to provide reentry of the tangs into the flexible circuit.

It will be appreciated that these and other crimpable connecting devices for flat conductor cable in the prior art require that some extraordinary preparation be made in the cable or circuit being terminated to accommodate the connector, cr that a cable having relatively wide interspaces between the conductors be chosen to prevent adjacent connectors from making electrical contact. These factors may significantly limit the utility of the cable or circuit used and, in addition, impose substantial economic restraints on the utilization of the cable or circuit. Moreover, these prior art connectors may form an electrical contact which may have certain undesirable characteristics. For example, the electrical contact made between prior art connecting devices and the conductor cable may occur over an insufficient number of points to perform satisfactorily. In addition, these prior art connectors may not provide a sufficiently tight mechanical engagement of the conductor to produce a satisfactory electrical contact over a relatively long life.

It would, therefore, be desirable to provide a novel method and apparatus for terminating flexible flat conductor cables which minimizes or reduces at least the problems of the type previously noted in connection with prior art devices.

OBJECTS AND SUMMARY OF A PREFERRED EMBODIMENT OF THE INVENTION

An object of the present invention is to provide a novel method and apparatus for terminating flexible flat conductor cable, and more particularly, one which may be utilized in conjunction with relatively small conductor spacings.

Another object of the present invention is to provide a novel method and apparatus for terminating flat conductor cable which provides an instantaneous termination of a conductor at any point along a length of flexible flat conductor cable, and more particularly one which provides for the instantaneous termination of multiple conductors simultaneously.

Yet another object of the present invention is to provide a novel method and apparatus for terminating flexible flat conductor cable wherein the conductor is completely penetrated to provide an improved electrical contact.

An additional object of the present invention is to provide a novel method and apparatus for terminating flexible flat conductor cable wherein there is no pre-perforation required to be made in the cable at the location of the cable termination.

A yet additional object of the present invention is to provide a novel method and apparatus for terminating flexible flat conductor cable wherein prongs on the terminating apparatus may be bent or crimped on a plane along a longitudinal axis of the conductor of the cable.

Still another object of the present invention is to provide a novel method and apparatus for terminating flexible flat conductor cable wherein portions of the conductor to which the apparatus is attached are isolated or trapped by the apparatus in order to provide an improved electrical contact with the conductor.

Still yet another object of the present invention is to provide a novel method and apparatus for terminating flexible flat conductor cable wherein electrical contacts are made at a multiplicity of points and wherein the integrity of these electrical contacts is maintained by an enforced biasing action of the conductor.

An additional object of the present invention is to provide a novel method and apparatus for teminating flat flexible conductor cable wherein cable penetration by portions of the contact and prong bending are effected by utilization of a die.

A further object of the present invention is to provide a novel method and apparatus for terminating flat conductor cable whereby one or more contacts may be readily attached to one or more of the conductors of the cable at practically any selected location and with essentially no preparation of the cable.

SUMMARY OF A PREFERRED EMBODIMENT OF THE INVENTION

A method and apparatus for terminating flexible flat conductor cable according to a preferred embodiment of the invention intended to substantially accomplish the foregoing objects includes a cable penetrating device for penetrating completely through a conductor portion of a flat conductor cable to provide thereat a first electrical and mechanical contact between the conductor portion and the contact apparatus. An engagement device is provided for also engaging the conductor portion at a location remote from the penetration of the conductor. This engagement device may include a bent-around portion of the cable penetrating device and an abutment body for providing a reaction surface against which the bent-around portion is operable to press the conductor. The bent-around portion of the penetrating device and the abutment body are cooperable to penetrate at least a portion of the insulative covering of the conductor portion of crimp the conductor at that location remote from the penetration. There is provided at the crimp a second electrical and mechanical contact between the conductor and the connector apparatus. Moreover, the crimp formed by the bent-around portion of the penetrating device and the abutment body may isolate or trap a portion of conductor between the location of penetration and the crimp. The abutment body may be carried by a pair of spring arms integral with the connector device. These spring arms may be operable to provide a relatively constant force tending to urge the bent-around portion of the penetrating device tightly against the conductor of the cable.

The penetrating device may include a pair of sharpened prongs. These prongs may be sharpened in such a manner as to provide a biased conductor bridge therebetween when the contact is attached to the conductor cable. This arrangement provides an advantageous conductive interface between the contact and the conductor.

The method of the present invention includes the steps of penetrating at a first location a conductor of a flexible flat conductor cable with a contact. The contact is then crimped between a penetrating device and an abutment surface at a second location to provide a secure electrical and mechanical contact between the conductor and the contact at a second location. This crimping action may isolate or trap portions of the conductor to provide an improved electrical contact.

Preferably a die is employed to effect cable penetration and prong bending. The die includes a bending surface cooperable with the prongs. The bending surface may be comprised of arcuate surfaces positioned adjacent one another to define a die nose receivable between the prongs.

With the prongs positioned to extend generally perpendicular to the direction of extent of the cable to a location adjacent the cable, and with the die positioned in general alignment with the contact, relative movement of the die and contact toward one another enforces: complete penetration of the prongs through a conductor portion of the cable; bending of prongs, under control of the die bending surfaces, away from one another and into an orientation with an opposite direction of extent; and engagement of the bent prongs with a conductor of the cable crimped between the prongs and the contact abutment surfaces. Where the cable includes insulation layers on both sides of the conductor, the single lancing operation enforces prong penetration through the insulation layers, penetration of the reverse bent prongs back into one layer and penetration of the abutment surfaces into the other insulation layer.

Other objects and advantages of the present invention will become apparent with reference to the following detailed description of a preferred embodiment thereof in connection with the accompanying drawings wherein like reference numerals have been applied to like elements in which:

BRIEF DESCRIPTION OF THE DRAWINGS

FIG. 1 is a front view of a contact according to the present invention prior to attachment to a conductor of a flat conductor cable;

FIG. 2 is a pictorial view of two of the contacts of FIG. 1 after having been attached to adjacent conductors of a flat conductor cable;

FIG. 3 is a partial side view, with the flat cable in longitudinal section, that schematically depicts in more detail an attachment of another form of contact according to the present invention to an insulated conductor, wherein the insulation material of the conductor has been displaced by a sharpened edge of the prongs to provide an advantageous electrical and mechanical contact with the conductor at multiple locations and wherein the prongs of the contact and a bending die are shown in phantom as they would appear prior to the prongs being lanced and bent around to repenetrate the cable;

FIG. 4 is a side view of a flexible flat conductor cable terminated at an intermediate location with a contact according to FIG. 3, which connector includes a hermaphroditic matable contact and has been assembled into an insulated housing shown in section;

FIG. 5 is an elevational view, partly in cross-section, of a connector assembly utilizing a further form of the present invention wherein a box type contact has been formed integrally with the pronged contact.

DETAILED DESCRIPTION

With reference to FIGS. 1 through 5, there may be seen a contact 10 for flexible flat conductor cable 12 in accordance with the present invention. The contact 10 is operable to penetrate completely through a conductor 13 embedded in the cable and to additionally form a crimp in the conductor. The contact 10 may include at one end 14 a solder tab or lug 16, or another matable contact for mating with a member of another connector (not shown).

The cable 12 may be any conventional flexible flat conductor cable comprised of a plurality of parallel and spaced-apart conductors 13, which are generally ribbon-like. These ribbon-like conductors are embedded in an insulating film 15 of a polyester or similar material. Mylar (polyethylene terephthalate), Kapton (a polyimide), and Teflon (polytetrafluoroethylene) are typically used as an insulating material in flat conductor cables. It is envisioned that these and a variety of other similar materials would be suitable.

To effect the penetration of the conductor 13, there are provided at another end 18 of the contact 10 a pair of prongs 20. These prongs are carried by a base portion 21 of the contact and have a sharpened or pointed end 22. The prongs are operable to displace the insulation of the cable and penetrate completely through the conductor embedded therein. As will be pointed out with greater particularity below, the periphery of stems 26 of both of these prongs 20 make electrical contact with the conductor 13 when the cable is penetrated thereby.

Each prong 20 comprises an elongate stem 26 and the end 22. That end 22 of each prong is preferably sharpened by the fashioning of an interior chamfer 28 and an exterior chamfer 30 at the end or distal terminus of the elongate stem 26. These chamfers or bevels are conventionally formed in such a manner that a relatively sharp top cutting or penetrating edge 32 is provided. Preferably, the exterior chamfer 30 is larger than the interior chamfer 28, i.e., the sharpened edge appears displaced from a central longitudinal axis 29 of each prong in a direction generally towards the opposing prong (see FIGS. 1 and 3).

Each of the prongs is bendable outwardly in a plane passing through the longitudinal axis of the conductor as shown in FIG. 3. As a result of this bending, the plastically deformed prongs may be made to contact the conductor again by penetrating through a top side 39 of the insulating material 15 on the flat conductor cable 12. Although bending in that plane is preferred, it is envisioned that many advantages of the present invention may be realized by positioning the contact in a direction orthogonal to that illustrated, and bending the prongs in an orthogonal plane.

An abutment means for the bent-around or deformed prongs is preferably provided to support the flat conductor cable 12 against the piercing or penetrating action of the re-entering cutting edge 32. In this connection, a pair of abutments 34 are provided on the contact apparatus.

These abutments 34 have a reaction surface 35 defined by an interior chamfer on back-up or abutment arms 50. This interior chamfer is cooperable with an exterior chamfer 36 on the abutment 34 to provide a sharp top edge 38.

This sharp edge 38 of the abutment 34 is spaced relative to the remaining contact portion so as to be operable to penetrate the insulation 15 on a bottom side 40 of the cable 12 and contact the conductor 13 when the cable is pressed thereagainst by the re-entry of the bent-around prongs 20 as may be seen in FIG. 3.

The forece used to bend the prongs 20 around to a position to squeeze the cable 12 between the end 22 of the prong and the abutment 34 should be regulated so as to effect a penetration of the insulating material 15 and contact with the conductor 13 but not necessarily a penetration through the conductor 13. The cuttting edges 32 and 38, after initial penetration of the cable, may be pressed generally obliquely against the cable at the crimping locations. That is to say, the crimped portion 27 of the conductor may be displaced out of the former plane of the conductor 13. As a result, a portion of the conductor 13 is tightly crimped by the end of the bent-around prong and the abutment of the contact.

It will be appreciated that electrical contact is made between the conductor 13 and the contact 10 at several engaging locations, viz., between each of the bent-around prongs and the conductor 13 adjacent its top surface 49 and between each of the reaction surfaces or chamfers 35 and the conductor 13 adjacent its bottom surface 51. The exact nature of the electrical contact between the prongs and the conductor and between the reaction surfaces and the conductor may vary depending upon circumstances. At any rate, surface contact, edge contact and/or point contact with the conductor is provided at the several engaging locations.

As noted above, electrical contact and mechanical connection occurs between the prongs 20 and the conductor at the apertures 24 where the prongs have penetrated the cable initially. It will be appreciated that electrical contact occurs around substantially the entire periphery of the prong 20.

Thus, in the practice of the present invention, electrical contact is made between the contact and the conductor at at least six distinct locations or zones. Each of the penetrating prongs 20 makes peripheral electrical contact with the conductor, and each set of engaging means makes electrical contact at the top and bottom of the crimp formed thereby.

As may be seen in FIG. 3, the sharpened edge 22 of each of the penetrating prongs 20 may deform slightly as the prong is being bent around with the result that the surface of each of the interior chamfers 28 is stretched slightly. This phenomenon serves both to facilitate re-entry of the prongs into the cable and enhance the area of the interior chamfers 38 available to make electrical contact with the conductor after the prong has been bent around.

In any event, it is desirable that the chamfers 35 and 28 be fashioned in a manner to facilitate a substantial coextensiveness of these surfaces subsequent to a bending around of the prong 20 and deformation of the face thereof. This arrangement results in a "sandwiching" action on the portion 27 of the conductor which defines the location of the crimp formed by the contact 10.

Of independent significance is the fact that the particular arrangement of chamfers 28 and 30 defining the sharpened edges 32 of the penetrating prongs 20 may provide improved electrical contact and mechanical connection between the interior faces or walls 42 of the stems 26 and the conductor (see FIG. 3). These sharpened edges "slice" a length of conductor having a slightly greater length than the distance between the interior walls 42 of the stems 26 of the prongs. As the conductor 13 and prongs are pressed together, the "sliced" portion of the conductor is forced to occupy a slightly less space with a result that a conductor bridge 44 is formed by the slice. It will be appreciated that this conductor bridge must bend or buckle slightly to squeeze or cram into the slightly shorter distance between the prongs. The formation of this conductor bridge 44, illustrated in FIG. 3 as downwardly concave, provides an advantageously flexing of the insulation material 46 and 48 aove and below the particular "sliced" portion of the conductor. The tensile and compressive forces set up in the flexed insulation serve to bias the conductor bridge 44 against the interior walls 42 of the prongs 20. It is believed that Mylar, Kapton and/or Teflon insulation material display characteristics suitable to provide the desired flexing action. Over relatively long periods, Kapton insulation appears to provide particularly advantageous characteristics in this regard. Hence, there is provided an especially secure electrical contact and mechanical connection between the interior walls or faces 42 of the penetrating prongs 20 and the conductor bridge 44 therebetween as a result of this arrangement of the sharpened edges 32.

In addition to the biasing action of the insulation material 46 and 48 covering conductor bridge 44, the conductor of the bridge itself may provide an additional spring action which enhances the biasing action.

Furthermore, a portion 45 of the conductor 13 may be isolated or trapped between the crimp and an exterior wall 43 of the stem 26 of the prong 20. As will be appreciated from the drawing of FIG. 3, the trapped portion 45 may be urged towards or crammed against the exterior wall 43, as a result of the cooperation of the prong and reaction surface 35, in a manner to improve the integrity of the electrical contact between the conductor 13 and the exterior wall 43.

The crimping action of the engaging means may be significantly improved by rendering the abutment arms 50, provided in conjunction with the abutment surfaces 34, springy. In this connection, as may be seen in the drawings, a pair of spring arms 50 is provided. These spring arms preferably are integral with the base portion 21 of the contact and are arranged to urge the abutment surfaces 34 against the conductor 13. The spring action provided by these spring arms also may improve the insulation stripping action of the respective cutting edges 38 and 32 of the reaction surfaces and the bent-around penetrating prong ends when the contact is attached to a conductor.

Moreover, the utilization of these spring arms provides a greater tolerance in the amount of force required to bend around the penetrating prongs in order to effect a satisfactory crimp. In addition, the spring action of the arms 50 permits slight movements of the matable contact portion 16, which movements may occur during termination by the contact 10, without significantly affecting the integrity of the electrical contacts fromed by the engaging means.

It will be appreciated that the spring arms exert a continuous bias against the prongs after they have been bent-around to form the crimp, thereby establishing biased, positive, electrical contact. Thus, there may be provided a continuously biased pair of edges or faces 28 and 35 which are counterposed to "sandwich" the crimped portion of the conductor therebetween when the contact is attached. Moreover, a biased contact bridge is formed by the sharpened edges 32 on the prongs with a result that a signicantly improved electrical contact may be made between the contact 10 and the conductor at several locations of biased mechanical connection or engagement.

The form of the invention shown in FIGS. 1 and 2 have the elongate matable contact 16 extending therefrom.

As alternatives to the extension 16 of FIGS. 1 and 2, the contact of the present invention may have a variety of mating elements formed integrally therewith. For example, as may be seen in FIG. 4, an Elco Corporation VARICON hermaphroditic contact 52, of the type described in U.S. Pat. No. 2,994,056, may be integrally fabricated together with a pronged contact according to the present invention. Such an arrangement would facilitate an advantageous and novel interconnection at any selected point on a length of flexible flat conductor cable as illustrated in FIG. 4.

It will be appreciated that in many instances, it may be desirable to utilize the apparatus and method of the present invention in conjunction with an insulative housing in order to form a convenient multiple connector plug assembly that may be disposed at a midpoint or end of a length of flexible flat conductor cable.

In FIG. 4 there may be seen an insulative housing 54 operable to hold a plurality of contacts 10 corresponding to a selected number of conductors in the flexible flat conductor cable 12. The individual contacts may be inserted in a conventional manner into the insulative housing. A projection 56 on the contact may facilitate securing the contact to the insulative housing.

A cover portion 58 may be used to provide additional support for the insulative housing 54 and to protect from accidental contact the bent-around prongs 20 as shown in FIG. 4.

The pronged contact of the present invention also may be formed with an Elco Corporation box contact 60, of the type disclosed U.S. Pat. No. 3,711,819, as shown schematically in FIG. 5. Contacts of this arrangement may be conventionally housed in an insulative housing 62, in order to provide another alternative termination for flat conductor cable.

It has been suitable to fashion the pronged contact 10 of the present invention from copper alloy. Phosphor bronze or other materials may also be employed. It is also envisioned that a conventional coating such as gold over nickel or suitable non-noble metal would be satisfactory.

With renewed reference to FIG. 3, one preferred form of attachment of a contact to the cable according to the present invention may be more fully appreciated. Therein the contact 10 is shown as being held in a fixed position by a suitable jig or fixture indicated in phantom at 64. In this position, the spaced, bendable prongs 20 are initially oriented to extend generally perpendicular to the direction of extent of the cable 12 to a location adjacent that cable. This is also shown in phantom FIG. 3.

A die, indicated in phantom at 66 is positioned above the cable 12 and prongs 20 in generally alignment with the prongs. This die includes bending surfaces in the form of arcuate surfaces 68 positioned adjacent one another to define a die nose 70 receivable between the prongs. As illustrated the configuration of the arcuate bending surfaces 68 in such as to establish the final prong configuration shown in full lines in FIG. 3, and the dimensions of the illustrated rounded tip die nose 70 are such as to fit between the initial spacing the prongs, i.e. the die nose width is about equal to the prong spacing.

A lancing operation is accomplished by effecting relative movement of the die 66 and the contact 10 toward one another. In this connection a ram (not shown) attached to the die or the jig 64, or one ram to each, may be employed.

As will be appreciated, a single lancing operation will enforce initial prong penetration as earlier discussed and prong bending under control of the bending surfaces 68, as well as repenetration of the bent around prongs through the upper insulation layers and penetration of the abutment surfaces 34 into the lower insulation layer. At the same time, the die nose 70 is operable to force the conductor portion of the cable and the insulation between the prongs into crimped engagement with the prongs. The die may be employed to effect simultaneous terminations with a plurality of contacts 10.

SUMMARY OF THE ADVANTAGES AND SCOPE OF THE INVENTION

It will be appreciated that in the utilization of a contact according to the present invention, certain advantages are provided.

In particular, because of the arrangement of elements of the novel contact of the present invention, the contact does not require utilization of the interspace between adjacent conductors in a length of flat conductor cable. It is believed that the contact of the present invention may be used with flexible flat conductor cable having conductor interspacings in the order of 0.008 inch.

Moreover, the contact may be used with relatively narrow conductors of the flexible flat conductor cable. It is believed that because the prongs are bent in a plane passing through a longitudinal axis of the conductor, the contact of the present invention may be used with flexible flat conductor cable having conductor widths in the order of 0.017 inch. Where cable is utilized with a conductor having a significantly wider dimension, there may be considerable relaxation of the precision necessary to properly orient the contact prior to attachment, since a relatively wide zone would be available for satisfactory operation.

No significant cable preparation is necessary to attach a contact of the present invention to a flexible flat conductor cable. As noted above, means are provided for displacing insulation without the need for a pre-stripping or pre-perforating operation. As a result, flexible flat conductor cable may be virtually instantaneously terminated at any desired location in the practice of the present invention.

Because of the multiple support of the contact when it is attached to a conductor, the contact may be advantageously secured against undesirable movement.

Moreover, the utilization of the spring arms provides an improved crimp and biased electrical contact between the bent-around penetrating prongs and the reaction surfaces. These spring arms also take up metal relaxation that occurs when external crimping forces are removed.

The biased conductor bridge and the trapped or crammed conductor portions significantly improve the integrity of the electrical contacts made between the contact and the conductor. The redundant contact zones made with the conductor provide an advantageous arrangement for withstanding oxidation and other such factors which could tend to diminish the conductivity of the electrical connection.

Of independent significance, the contacts of the present invention may be used to provide cable-to-cable, cable-to-connector, and cable-to-printed circuit board connections in a virtually endless variety of applications.

Of additional importance is the facility with which a single lancing operation effects the connection under control of a die.

Thus, it is apparent that there has been provided, in accordance with the present invention, a method and apparatus for terminating a flexible flat conductor means that substantially satisfies the objects and advantages set forth above. It is also apparent that while the invention has been specifically described in conjunction with flexible flat conductor cable, the utility of the invention in conjunction with flexible circuits is also envisioned. Thus, as used herein, the term flexible flat conductor means is intended to embrace flat cable, flexible circuitry, etc. Although the present invention has been described in conjunction with specific forms thereof, it is evident that many alternatives, modifications, and variations will be apparent to those skilled in the art in light of the foregoing disclosure of the invention. Accordingly, it is intended that all such alternatives, modifications, and variations which fall within the spirit and scope of the invention as defined in the appended claims be embraced thereby.

What is claimed is:

1. A contact apparatus for flexible flat conductor means comprising:

penetrating means for penetrating completely through a conductor portion of said flat conductor means to provide at a first location electrical contact between said conductor portion and said contact apparatus; and crimping means including spring means cooperable with said penetrating means for forming a biased electrical contact at a second location on said conductor portion.

2. The contact apparatus of claim 1 wherein said cable penetrating means comprises a pair of sharpened pring means for penetrating completely through said flat conductor means at said first location and for piercing an insulative covering on said conductor means and electrically contacting said conductor at said second location.

3. The contact apparatus of claim 1 wherein said spring means of said crimping means comprises a pair of spring arms carried by said contact apparatus, each of said spring arms comprising a reaction surface operable to support said crimping means.

4. The contact apparatus of claim 3 wherein each of said spring arms has a sharpened edge means for piercing said insulative covering on said flat conductor means and electrically contacting said conductor at said second location.

5. A contact apparatus according to claim 1 wherein:

said penetrating means comprises at least one sharpened prong said said spring means comprises a spring arm providing a support for said conductor portion and wherein the sharpened prong in bent condition and said spring arm cooperate to crimp the conductor and cram and isolated portion thereof against the prong.

6. A contact apparatus for flexible flat conductor means comprising:

penetrating means for penetrating completely through a conductor portion of said flat conductor means at any preselected location on said flat conductor means to provide thereat a first electrical contact between said conductor portion and said contact apparatus; and conductor engagement means for engaging said conductor portion at a location remote from said penetration at said preselected location, said engagement means comprising:

a remote engagement portion of said penetrating means;

abutment means for providing a reaction surface against which said conductor portion of said flexible flat conductor means is supported when said engagement portion engages said conductor portion;

said engagement portion and said abutment means being operable to penetrate at least a portion of an insulative covering of said conductor portion at said remote location to provide thereat a second electrical contact between said conductor portion and said contact apparatus; and said abutment means comprising a pair of spring arms carried by said contact apparatus, each of said spring arms comprising a reaction surface operable to support said flexible flat conductor means against a penetrating force of said remote engagement portion of said penetrating means.

7. The contact apparatus of claim 6 wherein each of said spring arms has a sharpened edge means for penetrating said flexible flat conductor means to displace said insulative covering and electrically contact said conductor portion of said flexible flat conductor means.

8. A method of terminating a flexible flat conductor means, said method comprising the steps of:

penetrating completely through a conductor portion of said flat conductor means with a prong of a contact to provide thereat a first electrical contact; and crimping said conductor portion between said prong and a biased abutment surface on the contact to provide thereat a second, spring biased electrical contact.

9. The method of claim 8 wherein said penetrating step comprises passing a sharpened prong through said conductor portion of said flat conductor means.

10. The method of claim 9 wherein said crimping step comprises bending said sharpened prong to repenetrate the insulation of said flat conductor means and make electrical contact with the conductor at a location remote from a location of said initial penetrating.

11. The method of claim 8 including the steps of:

penetrating completely through said conductor portion of said flat conductor means with another prong on said contact to provide thereat a third electrical contact;

forming a slice of conductor having a length greater than the interspace between the prongs to provide a biased contact bridge between the prongs of the contact; and trapping a length of conductor between a crimp formed by said crimping step and one of the prongs of the contact to provide a biased contact against said one prong.

12. The method of claim 8 including the step of cramming an isolated portion of the conductor against the prong.

13. A method of terminating a flexible flat conductor means, the method comprising:

positioning (a) a contact having spaced, bendable prongs and abutment surfaces cooperable with the prongs and (b) the flexible flat conductor means in a position wherein the prongs extend generally perpendicular to the direction of extent of the flat conductor means to a location adjacent that flat conductor means;

positioning a die including bending surface means cooperable with the prongs in a position in general alignment with the prongs and the adjacent flat conductor means portion, said die including a nose section initially positioned in alignment with the space between the prongs; and relatively moving the die and the contact toward one another to enforce complete penetration of the prongs through a conductor portion of the flat conductor means, bending of the prongs, under control of the bending surface means of the die bending surface, generally away from one another and into orientation with a direction of extent generally opposite said direction of extent, engagement of the bent prongs with a conductor of the flat conductor means sandwiched between the prongs and the cooperable abutment surfaces of the contact that include reaction surfaces supporting the conductor, and crimping against the prongs of a flat conductor portion located between the penetrating prongs, the engagement of the bent prongs with the conductor of the flat conductor means crimped between the prongs and the cooperable abutment surfaces of the contact being enforced against spring biasing force provided by the abutment surfaces.

14. The method of claim 13 wherein the flat conductor means includes insulation layers on both sides of a conductor and wherein relative movement of the die and contact enforces:

complete penetration of the prongs through the insulation layers and the conductor, and penetration of the bent prongs and one insulation layer.

15. The method of claim 14 wherein relative movement of the die and contact enforces:

penetration of the abutment surfaces and one insulation layer.

16. A method of terminating a flexible flat conductor means, the method comprising:

positioning (a) a contact having spaced, bendable prongs and abutment surfaces cooperable with the prongs and (b) the flexible flat conductor means in a position wherein the prongs extend generally perpendicular to the direction of extent of the flat conductor means to a location adjacent that flat conductor means;

positioning a die including bending surface means cooperable with the prongs in a position in general alignment with the prongs and the adjacent flat conductor means portion; and relatively moving the die and the contact toward one another to enforce complete penetration of the prongs through a conductor portion of the flat conductor means, bending of the prongs, under control of the bending surface means of the die bending surface, generally away from one another and into orientation with a direction of extent generally opposite said direction of extent, and engagement of the bent prongs with a conductor of the flat conductor means sandwiched between the prongs and the cooperable abutment surfaces of the contact that include reaction surfaces supporting the conductor;

the engagement of the bent prongs with the conductor of the flat conductor means crimped between the prongs and the cooperable abutment surfaces of the contacts being enforced against spring biasing force provided by the abutment surfaces.

* * * * *